US009989302B2

(12) United States Patent
Heydel

(10) Patent No.: US 9,989,302 B2
(45) Date of Patent: Jun. 5, 2018

(54) DOMESTIC REFRIGERATION APPLIANCE AND METHOD FOR OPERATING A DOMESTIC REFRIGERATION APPLIANCE

(71) Applicant: BSH HAUSGERAETE GMBH, Munich (DE)

(72) Inventor: Adolf Heydel, Waldenbuch (DE)

(73) Assignee: BSH Hausegeraete GmbH, Munich (DE)

( * ) Notice: Subject to any disclaimer, the term of this patent is extended or adjusted under 35 U.S.C. 154(b) by 0 days. days.

(21) Appl. No.: 15/131,480

(22) Filed: Apr. 18, 2016

(65) Prior Publication Data

US 2016/0313055 A1 Oct. 27, 2016

(30) Foreign Application Priority Data

Apr. 22, 2015 (DE) ..... 10 2015 207 313

(51) Int. Cl.
*F25D 29/00* (2006.01)
*F25D 17/04* (2006.01)
(Continued)

(52) U.S. Cl.
CPC ..... *F25D 29/003* (2013.01); *E05F 15/71* (2015.01); *F25D 17/047* (2013.01); *F25D 23/028* (2013.01); *F25D 2700/02* (2013.01)

(58) Field of Classification Search
CPC .... F25D 17/047; F25D 23/028; F25D 29/003; F25D 2700/02; F25D 21/025; G01L 9/0033; G01L 9/0035; G01L 9/0036; G01L 9/0038; G01L 9/0082; G01L 9/0083; G01L 9/0085; G01L 9/0086; G01L 9/0041;
(Continued)

(56) References Cited

U.S. PATENT DOCUMENTS 2,697,352 A * 12/1954 Umphrey ..... G01L 19/0618 73/723
3,522,733 A * 8/1970 Schroeder ..... G01L 9/0035 73/726
(Continued)

FOREIGN PATENT DOCUMENTS

DE 102006061083 A1 6/2008
EP 0650041 A2 * 4/1995 ..... G01D 5/145
EP 2742844 A1 6/2014

*Primary Examiner* — Andrew M Roersma
(74) *Attorney, Agent, or Firm* — Laurence A. Greenberg; Werner H. Stemer; Ralph E. Locher

(57) ABSTRACT

A domestic refrigeration appliance has a heat-insulated carcass which has an inner container with a coolable interior space for storing food, a refrigeration device for cooling the coolable interior space, an assisting device, and a door leaf mounted pivotable relative to the carcass for opening and closing the interior space or a drawer which in the closed state is pushed into the coolable interior space in order to close it, and in the open state is at least partially withdrawn from the coolable interior space. The assisting device has an air pressure sensor configured to determine a change of the air pressure within the interior space due to a pushing and/or pulling on the closed door leaf or the closed drawer. The assisting device is configured to open the closed door leaf or the closed drawer automatically at least partially depending on the determined change in the air pressure.

13 Claims, 3 Drawing Sheets

(51) Int. Cl.
*F25D 23/02* (2006.01)
*E05F 15/71* (2015.01)

(58) Field of Classification Search
CPC ..... G01L 9/0051; G01L 9/007; G01L 9/0072; G01L 9/0073; G01L 9/0002; G01L 9/0004; G01L 9/0005; G01L 9/0026; G01L 9/0027; G01L 9/0029; G01L 9/003; G01L 9/0045
USPC ..... 73/719, 725, 734, 750, 735
See application file for complete search history.

(56) References Cited

U.S. PATENT DOCUMENTS 4,174,638 A * 11/1979 Zabler ..... G01L 9/0036 336/30
4,507,972 A * 4/1985 Morita ..... G01L 9/0038 73/706
5,224,384 A * 7/1993 Kremidas ..... G01L 9/0051 338/4
9,062,911 B2 6/2015 Keller et al.
2003/0205448 A1* 11/2003 Miller ..... G01L 9/0058 200/83 R
2004/0032252 A1* 2/2004 Amini ..... G01D 5/202 324/207.17
2005/0252300 A1* 11/2005 Miller ..... G01L 9/0058 73/715
2010/0307189 A1* 12/2010 Keller ..... F25D 17/047 62/449
2010/0327883 A1* 12/2010 Reinmuth ..... G01L 9/0072 324/681
2013/0291646 A1* 11/2013 Weisser ..... G01L 9/007 73/756
2014/0230483 A1* 8/2014 Kempfle ..... F25D 23/028 62/440
2015/0040674 A1* 2/2015 Ishihara ..... G01L 19/0636 73/724

* cited by examiner

DOMESTIC REFRIGERATION APPLIANCE AND METHOD FOR OPERATING A DOMESTIC REFRIGERATION APPLIANCE

CROSS-REFERENCE TO RELATED APPLICATION

This application claims the priority, under 35 U.S.C. § 119, of German application DE 10 2015 207 313.0, filed Apr. 22, 2015; the prior application is herewith incorporated by reference in its entirety.

BACKGROUND OF THE INVENTION

Field of the Invention

The invention relates to a domestic refrigeration appliance with an interior space, an assisting device for opening a door leaf or a drawer of the domestic refrigeration appliance, and a refrigeration device which is provided for cooling the interior space. The invention further relates to a method for operating a domestic refrigeration appliance of this type.

Published, non-prosecuted German patent application DE 10 2006 061 083 A1 discloses a domestic refrigeration appliance which has a heat-insulated carcass with an interior container. The interior container delimits a coolable interior space. The domestic refrigeration appliance contains a door leaf which is pivotable relative to the carcass to open and close the interior space and a door opening aid which has a control body and an air pressure sensor which is configured to determine an air pressure change within the coolable interior space due to a pushing and/or pulling on the closed door leaf, in order thereupon to open the closed door leaf automatically at least partially by the control body.

SUMMARY OF THE INVENTION

It is an object of the invention to provide a domestic refrigeration appliance with an improved assisting device having an air pressure sensor for assisted opening of a closed door leaf or a closed drawer.

The object of the invention is achieved by a domestic refrigeration appliance having a heat-insulated carcass which has an inner container with a coolable interior space for storing food, a refrigeration device for cooling the coolable interior space and an assisting device, as well as a door leaf mounted pivotable relative to the carcass for opening and closing the coolable interior space. The assisting device has an air pressure sensor which is configured to determine a change of the air pressure within the coolable interior space resulting due to a pushing and/or pulling on the closed door leaf and the assisting device is configured to open the closed door leaf automatically at least partially depending on the determined change in the air pressure. The air pressure sensor has a pressure chamber coupled to the interior space, an electric component arranged within the interior space and an evaluating device which is configured to evaluate at least one electrical variable of the electric component associated with the change in the air pressure, so that the assisting device opens the closed door leaf at least partially, dependent upon the evaluated electrical variable. The electric component has an areal component and an electrically conductive film spaced at a distance from the areal component. The door leaf is preferably mounted pivotable relative to an axis which preferably extends vertically.

In addition, or alternatively to the door leaf, the domestic refrigeration appliance according to the invention can have a drawer which, in the closed state, is pushed into the coolable interior space in order to close it and in the open state is at least partially withdrawn from the coolable interior space. In this case, the assisting device is configured to determine a change of the air pressure within the coolable interior space due to a pushing and/or pulling on the closed drawer in order thereupon to open the closed drawer at least partially.

The refrigeration device is preferably a refrigerant circuit. The refrigerant circuit contains a compressor and, in particular, a condenser connected downstream of the compressor, a throttle device connected downstream of the condenser and an evaporator which is arranged between the throttle device and the compressor.

Preferably mounted on the side of the door leaf or the drawer facing toward the coolable interior space is an elastic magnetic seal which, with the door leaf closed or with the drawer closed, lies sealingly against the carcass. The magnetic seal is elastic so that in the event of pushing on the closed door leaf or on the closed drawer, the door leaf or drawer moves a little in the direction of the coolable interior space, so that the air pressure within the coolable interior space changes. Due to the elastic magnetic seal, in the event of pulling on the closed door leaf or on the closed drawer, the magnetic seal does not detach immediately from the carcass, so that the air pressure within the coolable interior space likewise changes.

This change of the air pressure can be determined by the air pressure sensor of the assisting device, so that the wish of a person to open the closed door leaf or the closed drawer can be concluded.

The pressure measuring range of the air pressure sensor is, for example ±0.2 mbar and the bursting pressure is, for example, ±50 mbar.

The assisting device preferably contains a control body, for example, a plunger which can be moved automatically by an actuator, for example, from a driven in to a driven out position, in order to open the closed door leaf or the closed drawer at least partially, preferably at least so far that the magnetic seal detaches from the carcass.

The assisting device also contains the air pressure sensor. According to the invention, this contains the pressure chamber which is coupled to the coolable interior space, the electric component arranged within the pressure chamber and the evaluating device which is configured to evaluate at least one electrical variable of the electric component that is associated with the change in the air pressure, so that the assisting device opens the closed door leaf or the closed drawer at least partially, dependent upon the evaluated electrical variable. The pressure chamber is coupled, for example, via an entry, to the coolable interior space, so that the change in the air pressure within the interior space is transferred to the pressure chamber. By this means, the at least one electrical variable of the component arranged within the pressure chamber is changed.

The electric component contains an areal component and the electrically conductive film spaced at a distance from the areal component. A change in the air pressure brings about a force on the electrically conductive film, by which means, the distance between the areal component and the electrically conductive film changes at least partially. By this means, the at least one electrical variable of the component is changed. This change is evaluated automatically with the evaluating device, by which means, it is possible to recognize pulling or pushing on the closed door leaf or on the closed drawer. The change in the at least one electrical variable is a measure, in particular, of the change in the air pressure. Subsequently, the assisting device automatically becomes active in order to open the closed door leaf or the closed drawer at least partially. This is realized, for example, in that the evaluating device controls the actuator so that it moves the control body from its driven in to its driven out position.

A further aspect of the invention therefore relates to a method for operating the domestic refrigeration appliance according to the invention. The method includes the following steps of:

a) determining a value or a change in the at least one electrical variable of the electric component by the evaluating device, so that the at least one electrical variable is changed due to an at least partially changing distance between the electrically conductive film and the areal component, caused by a change in the air pressure resulting from pulling or pushing on the closed door leaf or on the closed drawer;

b) evaluating the determined value or the determined change in the at least one electrical variable by the evaluating device; and c) dependent upon the evaluation, activating the assisting device, so that it opens the closed door leaf or the closed drawer at least partially.

In accordance with a preferred embodiment of the domestic refrigeration appliance according to the invention, the electric component is an inductive component. In this case, the areal component is configured as an areal electrical coil. The at least one electrical variable is preferably an inductance, a resistance and/or a reactance of the inductive component. According to this variant, therefore, an inductive process is utilized. The areal coil is arranged, for example, on a circuit board or integrated therein. Arranged at a specified distance from the areal coil is the electrically conductive film, for example, a membrane which, on a change of pressure, changes the distance from the areal coil at least partially. The change in the distance leads to a change in the electrical values or variables of the inductive component. The electrical variables are, for example, inductance, resistance or impedance and/or reactance. The coil is constructed areal and interacts with the electrically conductive film. An alternating current or an alternating magnetic field of the areal coil generates an induction voltage in the electrically conductive film, which evokes eddy currents which, in turn, produce a reaction in the areal coil.

According to one variant of the domestic refrigeration appliance according to the invention, the electric component is a capacitor. In this case, the areal component is a first areal electrode and the electrically conductive film is a second areal electrode of the capacitor. The at least one electrical variable is preferably a capacitance of the capacitor. Herein, therefore, a capacitive method is used. The capacitor contains the two areal electrodes. The first areal electrode is arranged on a circuit board or integrated into a circuit board. The second areal electrode is formed by the electrically conductive film which is arranged spaced from the first areal electrode. This creates a capacitor. When the pressure is changed, the distance of the electrically conductive film from the circuit board or from the first areal electrode is altered, so that the capacitance is changed as an electrical variable of the capacitor. Based on an evaluation of the capacitance or a change thereof, a pushing or pulling on the closed door leaf or the closed drawer can be detected.

The evaluating device can preferably contain an oscillator circuit with which the at least one electrical variable or the change therein can be measured.

In order to maintain a pre-determined distance between the areal component and the electrically conductive film, the air pressure sensor can comprise a spacing ring which is arranged between the areal component and the electrically conductive film. The spacing ring is made, in particular, of an electrically non-conductive material.

The air pressure sensor can have a circuit board with a surface. In this case, the areal component is arranged on the surface, in particular in a depression of the surface. By means of the depression, the distance between the areal component and the electrically conductive film can also be realized.

Further components of the air pressure sensor and/or the assisting device can also be arranged on the circuit board. Thus, for example, an electronic system of the evaluating device can be arranged on the circuit board. Preferably, however, only the areal component is arranged on the circuit board. By this means, at least a partial mechanical decoupling of the electric component from other components of the air pressure sensor, for example, the evaluating device, can be achieved.

According to one variant of the domestic refrigeration appliance according to the invention, the air pressure sensor contains a housing which delimits the pressure chamber and which has an entry to the pressure chamber, the entry being coupled to the interior space. The housing of the pressure chamber is preferably made of plastics and/or in particular integrally.

The housing of the pressure chamber can contain an opening which is closed by the circuit board such that the surface of the circuit board faces toward the pressure chamber and the areal component is arranged in the region of the opening within the pressure chamber. This can simplify the assembly of the air pressure sensor.

The circuit board can comprise a peripherally extending edge which overlaps an edge of the opening at least partially, in particular, completely.

According to a preferred embodiment of the domestic refrigeration appliance according to the invention, the assisting device has a housing within which substantially all the components of the assisting device are arranged. Preferably, in particular, all the electrical and any mechanical components necessary for the operation of the assisting device are arranged within the housing, possibly except for an electrical power supply. Any control body possibly provided is preferably also arranged in the housing, but then projects at least partially out of the housing at least in its driven out position. The housing of the assisting device is preferably made of plastics.

Preferably, the pressure chamber is provided in the housing, i.e. delimiting walls of the pressure chamber are an integral component of the housing of the assisting device.

Preferably, the housing of the assisting device contains an entry connected directly to the pressure chamber and coupled to the coolable interior space. By this means, the pressure chamber can be relatively easily connected or coupled to the interior space, for example, via a hose, since the hose can be relatively easily connected from outside the housing of the assisting device.

The housing of the assisting device preferably contains two housing parts. Preferably, the pressure chamber of the air pressure sensor is provided in one of the housing parts. The remaining components of the assisting device are then fastened to the other housing part.

Preferably, this variant also contains the circuit board. Preferably, however, only the areal component is arranged on the circuit board. Further components of the assisting device, in particular an electronic unit of the evaluating device can be arranged on a further circuit board which is arranged inside the housing of the assisting device.

The circuit board and the further circuit board are preferably connected to one another via elastic electrical connections in order to achieve at least a partial mechanical decoupling.

Preferably the further circuit board is arranged on the housing part in which the pressure chamber is not provided.

Other features which are considered as characteristic for the invention are set forth in the appended claims.

Although the invention is illustrated and described herein as embodied in a domestic refrigeration appliance and a method for operating a domestic refrigeration appliance, it is nevertheless not intended to be limited to the details shown, since various modifications and structural changes may be made therein without departing from the spirit of the invention and within the scope and range of equivalents of the claims.

DETAILED DESCRIPTION OF THE INVENTION

Figure 1:
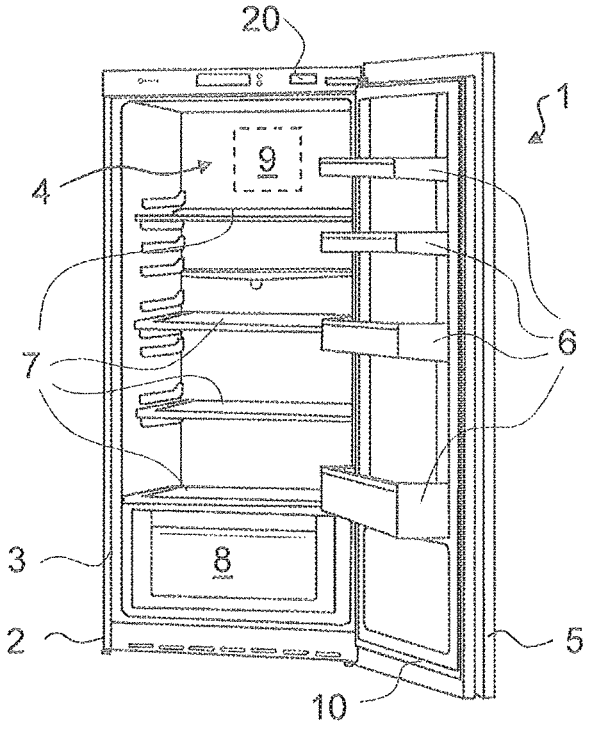
FIG. 1 is a diagrammatic, perspective view of a domestic refrigeration appliance with a door leaf and an assisting device for opening the door leaf according to the invention.

Referring now to the figures of the drawings in detail and first, particularly to FIG. 1 thereof, there is shown, in a perspective view, a domestic refrigeration appliance 1 which contains a heat-insulated carcass 2 with an inner container 3 which delimits a coolable interior space 4. The coolable interior space 4 is provided for storing non-illustrated foodstuff.

In the case of the present exemplary embodiment, the domestic refrigeration appliance 1 has a pivotable door leaf 5 for closing the coolable interior space 4. The door leaf is mounted, in particular, pivotable relative to a vertically extending axis. With the door leaf 5 open as shown in FIG. 1, the coolable interior space 4 is accessible.

Arranged on the side of the door leaf 5 facing toward the coolable interior space 4 in the case of the present exemplary embodiment are a plurality of door storage units 6 for storing food. Arranged in the coolable interior space 4 are, in particular, a plurality of shelves 7 for storing food and arranged, in particular, in the lower region of the coolable interior space 4 is a drawer 8 in which, also, food can be stored.

The domestic refrigerator 1 contains a refrigeration device configured, in particular, as a refrigerant circuit for cooling the coolable interior space 4. The refrigerant circuit contains, in particular, a compressor, a condenser connected downstream of the compressor, a throttle device which is configured, in particular, as a throttle pipe or capillary pipe connected downstream of the condenser, and an evaporator which is arranged between the throttle device and the compressor. The compressor is preferably arranged within a mechanism chamber of the domestic refrigeration appliance 1, which is arranged, in particular, behind the drawer 8.

In the case of the present exemplary embodiment, the domestic refrigeration appliance 1 contains an electronic control device 9 which is configured to control the refrigeration device, in particular the compressor of the refrigerant circuit in a manner that is commonly known to persons skilled in the art, such that the coolable interior space 4 has approximately a pre-determined or pre-determinable target temperature. The electronic control device 9 is preferably configured such that it regulates the temperature of the coolable interior space 4. In order, if required, to obtain the target temperature of the coolable interior space 4, the domestic refrigeration appliance 1 can have at least one non-illustrated temperature sensor which is connected to the electronic control device 9.

Figure 2:
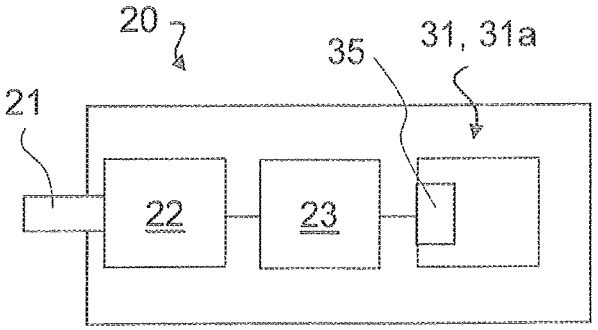
FIG. 2 is an illustration of a principle of the assisting device.

The domestic refrigeration appliance 1 also has an assisting device 20 which is configured at least to assist an opening of the closed door leaf 5. FIG. 2 shows an illustration of the principle of the assisting device 20.

The assisting device 20 is fastened, for example, in or on the carcass 2 and contains a control body, for example, a plunger 21 which can be moved automatically by an actuator 22 of the assisting device 20 from a driven in to a driven out position. In its driven in position, the plunger 21 permits closing of the door leaf 5 or the plunger 21 is pushed, on closing the door leaf 5, into its driven in position. The actuator 22 contains, for example, an electric motor. The actuator 22 is controlled, for example, by a controlling element 23, for example, a driver stage.

In the case of the present exemplary embodiment, the domestic refrigeration appliance 1 contains a magnetic seal 10 fastened on the side of the door leaf 5 facing toward the coolable interior space 4, the magnetic seal lying, with the door leaf 5 closed, against the front face of the carcass 2. The magnetic seal 10 is elastic so that in the event of pushing on the closed door leaf 5, it moves a little in the direction of the coolable interior space 4, so that the air pressure within the coolable interior space 4 changes. Due to the elastic magnetic seal 10, in the event of pulling on the closed door leaf 5, the magnetic seal 10 does not detach immediately from the carcass 2, so that the air pressure within the coolable interior space 4 likewise changes.

In the case of the present exemplary embodiment, the assisting device 20 is configured such that it recognizes the wish of a person to open the door leaf 5 as soon as the person pulls or pushes on the closed door leaf 5. Thereupon, the actuator 22 automatically moves the plunger 21 from its driven in position into its driven out position. During this movement, the plunger 21 pushes the door leaf 5 open at least so far that the magnetic seal 10 detaches from the carcass 2 so that the person can more easily open the door leaf 5 completely.

Based on a measurement and evaluation of the change in the air pressure within the coolable interior space 4, a pulling or pushing on the door leaf 5 and therefore the wish of a person to open the closed door leaf 5 can thus be deduced.

Figure 3:
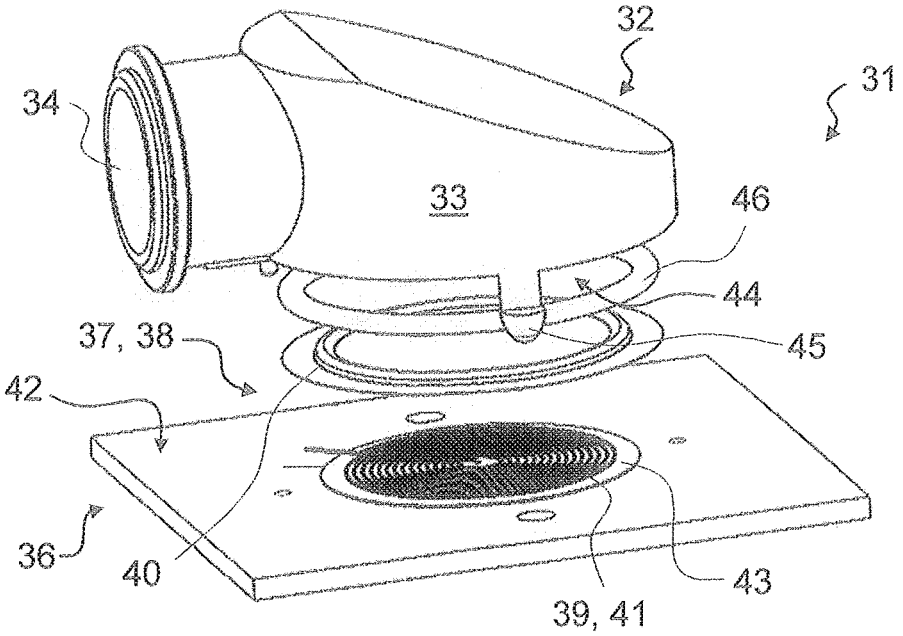
FIG. 3 is an exploded, perspective view of an embodiment of an air pressure sensor of the assisting device.

In the case of the present exemplary embodiment, the assisting device 20 contains an air pressure sensor which is configured to determine the air pressure within the coolable interior space 4 or a change in this air pressure, so that, depending on the change in this air pressure, the assisting device 20 becomes active and automatically moves the plunger 21 from its driven in position into its driven out position. FIG. 3 shows an embodiment of an air pressure sensor 31 in an exploded view. The air pressure sensor 31 contains a pressure chamber 32.

In one embodiment of the assisting device 20, the air pressure sensor 31 contains a housing 33, shown in FIG. 3, which delimits a pressure chamber 32. The housing 33 is preferably made of plastics and is constructed, in particular, integrally. The housing 33 contains an entry 34 by which the pressure chamber 32 is coupled, for example, via a hose (not shown) to the coolable interior space 4.

The air pressure sensor 31 also contains an electric component 37 arranged within the pressure chamber 32 and an evaluating device 35 connected to the electric component 37, the evaluating device being configured to control the actuator 22 or the controlling element 23.

In the exemplary embodiment shown in FIG. 3, the pressure sensor 31 has a circuit board 36 on which, for example, the evaluating device 35 can also be arranged.

The air pressure sensor 32 contains the electric component 37 which in the case of the exemplary embodiment shown in FIG. 3 is configured as an inductive component 38. The electric component 37 or the inductive component 38 is arranged within the pressure chamber 32.

The electric component 37 contains an areal component 39 and an electrically conductive film 40 spaced at a distance from the areal component 39. In the case of an electric component 37 configured as an inductive component 38, the areal component 39 is an areal electric coil 41. The areal electric coil 41 is preferably configured multi-layered.

The areal component 39 or the areal electric coil 41 is arranged or fastened, in particular, on a surface 42 of the circuit board 36, preferably in a depression 43 in this surface 42 of the circuit board 36. For example, by reason of the depression 43, it is possible to arrange the electrically conductive film 40 spaced from the areal component 39 or to arrange the areal electric coil 41 within the pressure chamber 32.

Preferably, an electrically non-conductive spacing ring (not shown in FIG. 3) can be provided between the areal component 40 or the areal electric coil 41.

In the case of the exemplary embodiment shown in FIG. 3, the housing 33 of the pressure chamber 32 contains a preferably circularly configured opening 44 and fastening device 45 with which the housing 33 of the pressure chamber 32 is fastened to the circuit board 36. The fastening device 45 is preferably a locking device or locking hooks with which the housing 33 of the pressure chamber 32 is locked to the circuit board 36.

The housing 33 of the pressure chamber 32 is fastened to the circuit board 36 such that the surface 42 on which the areal component 39 or the areal electric coil 41 is arranged faces toward the pressure chamber 32 and closes the opening 44, and that the areal component 39 or the areal electric coil 41 is arranged in the region of the opening 44 within the pressure chamber 32.

In the case of the exemplary embodiment shown in FIG. 3, the opening 44 is sealed with a sealing ring 46.

As already set out, a pulling or pushing on the closed door leaf 5 causes a change in the air pressure within the coolable interior space 4. Since this space is coupled to the pressure chamber 32, this change in the air pressure is transferred to the pressure chamber 32, by which means a force is exerted on the electrically conductive film 40. By this means, the distance between the electrically conductive film 40 and the areal component 39 or the areal electric coil 41 changes at least partially.

The change in the distance leads in general to a change in the electrical variable of the electric component 37, in particular, to a change in the inductance, reactance and/or resistance of the inductive component 38. Since specifically the areal coil 41 interacts with the electrically conductive film 40, for example, an alternating current flowing through the areal coil 41 or an alternating magnetic field of the areal coil 41 generates an induction voltage in the electrically conductive film 40. This leads to eddy currents which, in turn, have a retroactive effect on the areal coil 41.

It is therefore possible, by means of the evaluating device 35 to evaluate at least one electrical variable of the electric component 37 associated with the change of the air pressure within the coolable interior space 4, so that the assisting device 20 or the evaluating device 35 thereof controls the controlling element 23 in such a way that the actuator 22 moves the plunger 21 from its driven in position to its driven out position in order to open the closed door leaf 5 at least partially.

In the case of the inductive component 38, the at least one electrical variable is its inductance, its resistance and/or its reactance. These electrical variables can be determined or evaluated by means of an oscillating circuit of the evaluating device 35.

Figure 4:
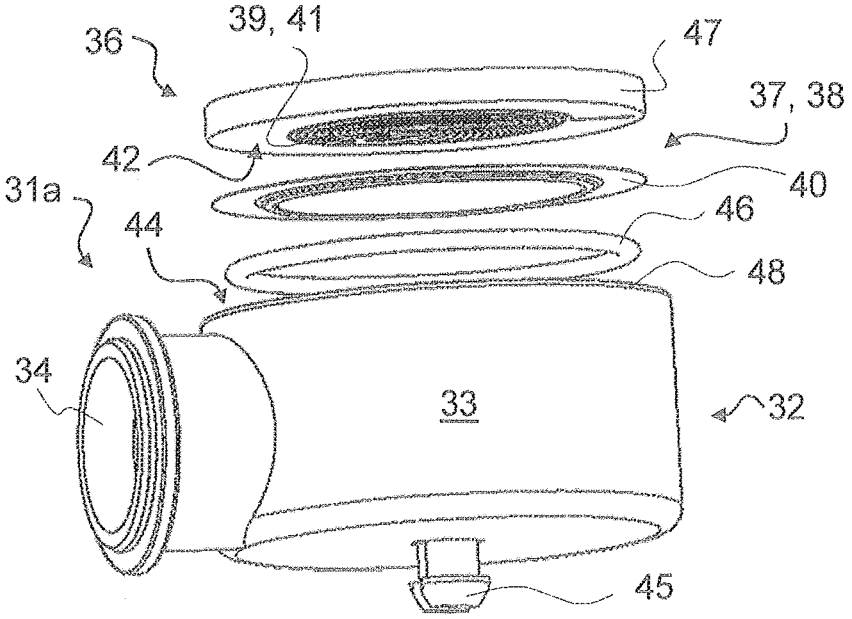
FIG. 4 is an exploded, perspective view of an alternative embodiment of the air pressure sensor of the assisting device.

FIG. 4 shows an alternative embodiment of an air pressure sensor 31*a* which can be used in place of the air pressure sensor 31 shown in FIG. 3 for the assisting device 20. If not described otherwise, components of the air pressure sensor 31*a* shown in FIG. 4 which are structurally and functionally identical to components of the air pressure sensor 31 shown in FIG. 3 are identified with the same reference signs.

The circuit board 36 of the air pressure sensor 31 shown in FIG. 4 is preferably circular and contains a peripherally circumferential edge 47. The size of the circuit board 36 is adapted to the size of the opening 44 of the housing 33 of the pressure chamber 32 and closes this opening such that the surface 42 on which the areal component 37 or the areal coil 41 is arranged faces toward the pressure chamber 32 and thus the areal component 37 or the areal coil 41 is arranged within the pressure chamber 32. Furthermore, the edge 48 of the opening 44 of the housing 33 overlaps the edge 47 of the circuit board 36 at least partially, preferably completely.

The evaluating device 35 or the electronic components of the evaluating device 35 are arranged on a further circuit board not shown in FIG. 4. Thus the electric component 37 or the inductive component 38 is at least partially mechanically decoupled from further components of the assisting device 20.

The housing 33 of the pressure chamber 32 of the air pressure sensor 31*a* shown in FIG. 4 is fixed with the fastening device 45 not to the circuit board 36, but to a further component (not shown) of the assisting device 20, for example, a housing of the assisting device 20 or to the further circuit board.

Figure 5:
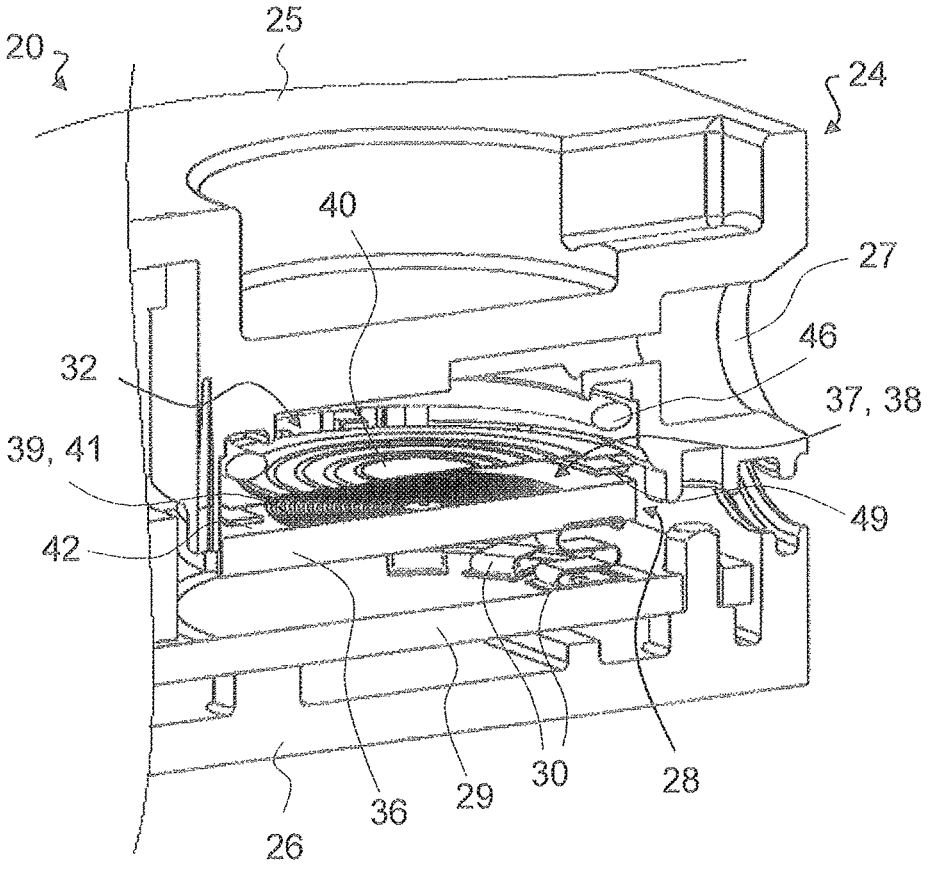
FIG. 5 is a cut-away perspective view of part of an embodiment of the assisting device.

FIG. 5 shows part of an embodiment of the assisting device 20 in a sectional perspective view.

The embodiment of the assisting device 20 shown in FIG. 5 contains a housing 24 within which substantially all the components of the assisting device 20 are arranged. In particular, the actuator 22, the controlling element 23 and the air pressure sensor are arranged within the housing 24.

The housing 24 of the assisting device 20 is preferably made of plastics and preferably contains two housing parts 25, 26.

The housing 24 of the embodiment of the assisting device 20 shown in FIG. 5 is configured such that the pressure chamber 32 is provided therein wherein, in particular, the housing 24 of the assisting device is provided with the pressure chamber 32 of the air pressure sensor. The pressure chamber 32 is therefore an integral component of the housing 24, and in the case of the embodiment shown in FIG. 5, is an integral component of the housing part 25.

The pressure chamber 32 is formed by a depression in the housing 24 of the assisting device 20.

The housing 24 of the assisting device 20 preferably contains an entry 27 which is directly linked to the pressure chamber 33, by which the pressure chamber 32 is coupled, for example, via a hose (not shown) to the coolable interior space 4.

The air pressure sensor further contains the electric component 37 arranged within the pressure chamber 32 or the inductive component 38, that is, the areal component 39 or the areal coil 41 and the electrically conductive film 40 spaced from the areal component 39.

For the embodiment shown in FIG. 5 also the circuit board 36 is provided, on the surface 42 of which the areal component 39 or the areal coil 41 is fastened.

The delimiting walls of the pressure chamber 32 have, in particular, an opening 28 which is closed by the circuit board 36. Preferably, the size of the circuit board 36 is adapted to the size of the opening 28 of the pressure chamber 32 and closes this opening such that the surface 42 of the circuit board 36 on which the areal component 37 or the areal coil 41 is arranged faces toward the pressure chamber 32 and thus the areal component 39 or the areal coil 41 is arranged within the pressure chamber 32.

Preferably, an electrically non-conductive spacing ring 49 is provided between the areal component 39 or the areal electric coil 41 and the electrically conductive film 40.

In the case of the exemplary embodiment shown in FIG. 5, the sealing ring 46 is also provided so that the electrically conductive film 40 is clamped between the sealing ring 46 and the spacing ring 49.

The embodiment of the assisting device 20 shown in FIG. 5 contains a further circuit board 29 on which, for example, the evaluating device 35 or an electronic unit of the evaluating device 35 is arranged. Electrical connections 30 are provided for an electrical connection of the electric component 37 of the inductive component 38 to the evaluating device 35. The electrical connections 30 connect, in particular, the circuit board 36 to the further circuit board 29. The electrical connections 30 are preferably elastic. Preferably, the further circuit board 29 is arranged on the housing part 26 in which the pressure chamber 32 is not provided.

The electric component 37 can also be configured as a capacitor. In this case, the areal component 39 is a first areal electrode and the electrically conductive film 40 is a second areal electrode. The at least one electrical variable which is evaluated with the evaluating device 35 is then the capacitance of the capacitor, which changes on a change of the distance between the two areal electrodes.

The domestic refrigeration appliance 1 can also have a drawer which is at least partially withdrawable from the coolable interior space 4 and is pushable into the coolable interior space 4. In the pushed in state, this drawer closes the coolable interior space 4. If this drawer is at least partially withdrawn from the coolable interior space 4, then it is opened. The assisting device 20 can also be provided to recognize the wish to open the drawer.

In the case of the present exemplary embodiment, the assisting device 20 is configured such that it recognizes the wish of a person to open this drawer as soon as the person pulls or pushes on the closed drawer. Thereupon, the actuator 22 automatically moves the plunger 21 from its driven in position into its driven out position. During this movement, the plunger 21 pushes the drawer open at least so far out of the coolable interior space 4 that a magnetic seal of the drawer detaches from the carcass 2 so that the person can more easily open the drawer completely.

The following is a summary list of reference numerals and the corresponding structure used in the above description of the invention:

1 Domestic refrigeration appliance
2 Carcass
3 Inner container
4 Coolable interior space
5 Door leaf
6 Door storage unit
7 Shelf
8 Drawer
9 Electronic control device
10 Magnetic seal
20 Assisting device
21 Plunger
22 Actuator
23 Controlling element
24 Housing
25, 26 Housing part
27 Entry
28 Opening
29 Circuit board
30 Electrical connections
31, 31*a* Air pressure sensor
32 Pressure chamber
33 Housing
34 Entry
35 Evaluating device
36 Circuit board
37 Electric component
38 Inductive component
39 Areal component
40 Electrically conductive film
41 Areal electric coil
42 Surface
43 Depression
44 Opening
45 Fastening means
46 Sealing ring
47, 48 Edge
49 Spacing ring

The invention claimed is:

1. A domestic refrigeration appliance, comprising:

a heat-insulated carcass having an inner container with a coolable interior space for storing food;

a refrigeration device for cooling said coolable interior space;

an assisting device;

a closeable device selected from the group consisting of a drawer and a door leaf, said door leaf mounted pivotable relative to said carcass for opening and closing said coolable interior space; or said drawer which in a closed state is pushed into said coolable interior space in order to close said drawer thus resulting in a closed drawer, and in an open state is at least partially withdrawn from said coolable interior space;

said assisting device having an air pressure sensor configured to determine a change of air pressure within said coolable interior space resulting due to a pushing and/or pulling on said door leaf in a closed state or on said closed drawer, said assisting device configured to open said door leaf or said closed drawer automatically at least partially depending on a determined change in the air pressure; and said air pressure sensor, containing:

a pressure chamber with an entry and coupled via said entry to said coolable interior space so that the change in the air pressure within the coolable interior space is transferred to said pressure chamber;

an inductive component disposed within said pressure chamber, said inductive component having an areal electric coil and an electrically conductive film spaced at a distance from said areal electric coil, so that the change in the air pressure is directly applied to said electrically conductive film causing a change in a distance between said electrically conductive film and said areal electric coil, resulting in a change in an inductance, a resistance and/or a reactance of said inductive component; and an evaluating device configured to evaluate the inductance, the resistance and/or the reactance of said inductive component associated with the change in the air pressure, so that said assisting device opens said door leaf or said closed drawer at least partially, dependent upon the inductance, the resistance and/or the reactance of said inductive component.

2. The domestic refrigeration appliance according to claim 1, wherein said air pressure sensor has a spacing ring which is disposed between said areal component and said electrically conductive film.

3. The domestic refrigeration appliance according to claim 1, wherein said air pressure sensor has a circuit board with a surface and said areal component is disposed on said surface.

4. The domestic refrigeration appliance according to claim 3, wherein only said areal component is directly disposed on said circuit board.

5. The domestic refrigeration appliance according to claim 3, wherein:

said air pressure sensor has a housing which delimits said pressure chamber and contains said entry to said pressure chamber;

said housing of said air pressure sensor has an opening formed therein which is closed by said circuit board such that said surface of said circuit board faces toward said pressure chamber and said areal component is disposed in a region of said opening within said pressure chamber; and said circuit board contains a peripherally circumferential edge which overlaps an edge of said opening at least partially.

6. The domestic refrigeration appliance according to claim 1, wherein said assisting device has a housing within which substantially all components of said assisting device are disposed and in which said pressure chamber is provided.

7. The domestic refrigeration appliance according to claim 6, wherein said housing of said assisting device has said entry which is directly linked to said pressure chamber and is coupled with said coolable interior space.

8. The domestic refrigeration appliance according to claim 1, wherein said air pressure sensor contains a circuit board having a surface with a depression formed therein, said areal component is disposed in said depression of said surface.

9. The domestic refrigeration appliance according to claim 1, wherein said closeable device has an elastic magnetic seal which lies sealingly on said carcass when said closeable device is closed.

10. The domestic refrigeration appliance according to claim 1, wherein said drawer has an elastic magnetic seal which lies sealingly on said carcass when said drawer is closed.

11. The domestic refrigeration appliance according to claim 1, wherein said electrically conductive film delimits said pressure chamber.

12. The domestic refrigeration appliance according to claim 1, wherein the air pressure is directly applied to a surface of said electrically conductive film.

13. A method for operating a domestic refrigeration appliance, which comprises the steps of:

providing the domestic refrigeration appliance to contain:

a heat-insulated carcass having an inner container with a coolable interior space for storing food;

a refrigeration device for cooling the coolable interior space;

an assisting device;

a closeable device selected from the group consisting of a drawer and a door leaf:

the door leaf mounted pivotable relative to the carcass for opening and closing the coolable interior space; or the drawer which in a closed state is pushed into the coolable interior space in order to close the drawer thus resulting in a closed drawer, and in an open state is at least partially withdrawn from the coolable interior space;

the assisting device having an air pressure sensor configured to determine a change of air pressure within the coolable interior space resulting due to a pushing and/or pulling on the door leaf in a closed state or on the closed drawer, the assisting device configured to open the door leaf or the closed drawer automatically at least partially depending on a determined change in the air pressure;

the air pressure sensor, containing:

a pressure chamber with an entry and coupled via the entry to the coolable interior space so that the change in the air pressure within the coolable interior space is transferred to the pressure chamber;

an inductive component disposed within the pressure chamber, the inductive component having an areal electric coil and an electrically conductive film spaced at a distance from the areal electric coil, so that the change in the air pressure is directly applied to the electrically conductive film causing a change in a distance between the electrically conductive film and the areal electric coil, resulting in a change in an inductance, a resistance and/or a reactance of the inductive component; and an evaluating device configured to evaluate the inductance, the resistance and/or the reactance of the inductive component associated with the change in the air pressure, so that the assisting device opens the door leaf or the closed drawer at least partially, dependent upon the inductance, the resistance and/or the reactance of the inductive component;

determining a value or a change in at least one electrical variable of the inductive component by means of the evaluating device, the at least one electrical variable selected from the group consisting of the inductance, the resistance and the reactance of the inductive component, so that the at least one electrical variable is changed due to an at least partially changing distance between the electrically conductive film and the areal electric coil caused by the change in the air pressure resulting from the pulling or pushing on the door leaf or on the closed drawer;

evaluating a determined value or a determined change in the at least one electrical variable by means of the evaluating device; and activating the assisting device, so that the assisting device opens the door leaf or the closed drawer, based at least partially in dependence upon the evaluating step.

* * * * *